US009281642B1

(12) United States Patent
Tseng

(10) Patent No.: US 9,281,642 B1
(45) Date of Patent: Mar. 8, 2016

(54) CONNECTOR IN WHICH GROUNDING BOARDS ARE COMBINED WITH ASSEMBLY TONGUE PLATE

(71) Applicant: SIMULA TECHNOLOGY INC., Taoyuan Dist., Taoyuan (TW)

(72) Inventor: Te-Chih Tseng, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 14/624,952

(22) Filed: Feb. 18, 2015

(30) Foreign Application Priority Data

Dec. 1, 2014 (TW) ..... 103221250 U

(51) Int. Cl.

| | |
|---|---|
| ***H01R 24/00*** | (2011.01) |
| ***H01R 24/60*** | (2011.01) |
| ***H01R 13/506*** | (2006.01) |
| *H01R 107/00* | (2006.01) |

(52) U.S. Cl.
CPC ..... *H01R 24/60* (2013.01); *H01R 13/506* (2013.01); *H01R 2107/00* (2013.01)

(58) Field of Classification Search
CPC . H01R 12/724; H01R 13/652; H01R 12/6581
USPC ..... 439/676, 607.4
See application file for complete search history.

(56) References Cited

U.S. PATENT DOCUMENTS

| | | | | |
|---|---|---|---|---|
| 4,824,383 | A * | 4/1989 | Lemke | H01R 24/60 439/108 |
| 7,758,379 | B2 * | 7/2010 | Chen | H01R 13/6485 439/607.11 |
| 8,851,927 | B2 * | 10/2014 | Hsu | H01R 13/6594 439/607.11 |
| 9,022,800 | B2 * | 5/2015 | Yang | H01R 13/6581 439/487 |
| 2014/0113481 | A1 * | 4/2014 | Little | H01R 13/64 439/374 |
| 2014/0154913 | A1 * | 6/2014 | Ho | H01R 27/00 439/488 |
| 2014/0349514 | A1 * | 11/2014 | Yang | H01R 13/6581 439/487 |

* cited by examiner

*Primary Examiner* — Abdullah Riyami
*Assistant Examiner* — Nader J Alhawamdeh
(74) *Attorney, Agent, or Firm* — Bacon & Thomas, PLLC

(57) ABSTRACT

The present disclosure is to provide a connector which is compatible to USB Type-C standard and includes an assembly tongue plate, two grounding boards and a metal casing. The assembly tongue plate includes a first terminal block made of plastic and having a plurality of first connection terminals disposed therein, a second terminal block made of plastic and having a plurality of second connection terminals disposed therein, and a metal separating plate being assembled between a bottom surface of the first terminal block and a top surface of the second terminal block. The two grounding boards can be fastened with each other to enclose outer edges of the first terminal block and second terminal block when the metal separating plate is assembled between the first terminal block and second terminal block, so as for allowing the assembly tongue plate to be easily and quickly assembled into the metal casing.

10 Claims, 2 Drawing Sheets

CONNECTOR IN WHICH GROUNDING BOARDS ARE COMBINED WITH ASSEMBLY TONGUE PLATE

FIELD OF THE INVENTION

The present disclosure generally relates to a connector, more particularly to a connector in which grounding boards are combined with assembly tongue plate.

BACKGROUND OF THE INVENTION

With improvements of communication technology and electronic technology, the electronic devices equipped with various functions, such as cell phones allowing worldwide people to communicate with each other, Walkman allowing people to listen music anytime and anywhere, personal computer assisting people to process many things, etc., have become necessary tools for modern persons in life and work. Currently, a variety of electronic devices can be combined integratedly, so the functions of using cell phone to listen music or using the personal computer to dial are implemented gradually. In order to receive electronic signals and power transmitted from the outside, the electronic devices must be equipped with a connector on a main body thereof. USB is the most popular standard in numerous transmission standards, and the USB connector can perform electric connection and signal transmission between devices, or between elements, or between systems, so as to integrate a basic element required by an integral system for transmitting electrical signal or current.

Currently, the USB standard is upgraded to USB 3.1 standard. In the USB 3.1 standard the transmission amounts of voltage and voltage are increased, and the transmission speed is also improved to 10 GB per second because of improvement in coding loss. In previous design of the connector, the manufacturer fastens connection terminals into a tongue plate by a manner of injection molding or insertion assembly. However, two groups of signal terminals of the USB connector must be designed to be very close for reducing occupied volume for achieving a sufficient slim structure of the connector. In addition, in order to prevent a problem that signals of two groups of connection terminals are interfered with each other during transmission, the manufacturer must place a metal separating plate between the two groups of connection terminals to isolate the signal interference and noise interference from the connection terminals. When the USB connector must be designed to be equipped with more metal elements (i.e. connection terminal, separating plate, etc.), it causes that the manufacturer cannot assemble products quickly, and the cost and yield rate of manufacturing such USB connector are impaired easily.

Therefore, for the special structural requirement of the USB connector, what is needed is to design an USB connector to enable the manufacturer to produce and assemble such USB connectors quickly with improved production yield rate and manufacturing cost both.

SUMMARY OF THE INVENTION

In order to solve the problems that the product cannot be assembled quickly and the manufacturer hardly improves manufacturing cost and production yield rate both due to the USB connector equipped with more metal elements (i.e. connection terminal, separating plate, etc.), the inventor designs a connector in which the grounding boards are combined with an assembly tongue plate based on long-term practice experience and repeated research and tests.

A first objective of the present disclosure is to provide a connector in which grounding boards are combined with an assembly tongue plate. The connector is compatible to USB Type-C standard and includes an assembly tongue plate, two grounding boards and a metal casing. The assembly tongue plate includes a first terminal block, a second terminal block and a metal separating plate. The first terminal block is made of plastic integrally, and provided with a plurality of first connection terminals fixedly disposed therein, portions of the plurality of first connection terminals are exposed a top surface of the first terminal block, and the first terminal block is provided with at least one first fastening part at a bottom surface thereof near an end thereof, for example, at least one fasten block is protrudingly disposed on the bottom surface. The second terminal block is made of plastic integrally and provided with a plurality of second connection terminals fixedly disposed therein. Portions of the plurality of second connection terminals are exposed out of a bottom surface of the second terminal block, and the second terminal block is provided with at least one second fastening part at a top surface thereof near an end thereof, for example, at least one fastening slot is concavely disposed on the top surface. The second fastening part corresponds to the first fastening part. Structures of a top surface and a bottom surface of the metal separating plate respectively match with a structure of a bottom surface of the first terminal block and a structure of a top surface of the second terminal block, to enable the metal separating plate to be assembled between the bottom surface of the first terminal block and the top surface of the second terminal block. Ends of the first terminal block, the metal separating plate and the second terminal block can be firmly integrated when the first fastening part is fastened into the second fastening part. Structures of the two grounding boards match with a structure of a top surface of the first terminal block near other end of the first terminal block and a structure of a bottom surface of the second terminal block near the other end of the second terminal block, to enable the grounding boards to be fastened with each other to enclose outer edges of the first terminal block and the second terminal block near to the other ends of the first terminal block and the second terminal block when the metal separating plate is assembled between the bottom surface of the first terminal block and the top surface of the second terminal block, whereby the other ends of the first terminal block, the metal separating plate and the second terminal block can be firmly integrated. The metal casing has a structure matching with the assembly tongue plate, so the assembly tongue plate can be assembled into the metal casing. Therefore, by just fastening the grounding boards with each other, the outer edges of the first terminal block and the second terminal block near other end thereof can be enclosed by the grounding boards, whereby the first terminal block, the metal separating plate and the second terminal block can be firmly integrated together to form the assembly tongue plate. Therefore, the assembly personnel can quickly assemble other ends of the first terminal block, the metal separating plate and the second terminal block together, so convenience and efficiency of assembly can be improved efficiently. In addition, the ends of the first terminal block, the metal separating plate and the second terminal block can be firmly fastened with each other by the fastening parts, so the production yield rate of the connector can be further improved efficiently.

A second objective of the present disclosure is that the metal separating plate is provided with at least one third fastening part extended forwardly from an end thereof, and at least one fourth fastening part is disposed at the bottom surface of the first terminal block near an end of the first terminal block or at the top surface of the second terminal block near an end of the second terminal block. The third fastening part corresponds to the fourth fastening part, so an end of the metal separating plate can be firmly integrated with the end of the first terminal block or the second terminal block in a condition that the third fastening part is fastened to the fourth fastening part.

A third objective of the present disclosure is that the metal separating plate is provided with a grounding plate downwardly extended from other end thereof, the first terminal block is provided with a first assembly part at other end thereof, the second terminal block is provided with a second assembly part at other end thereof, and when the metal separating plate is assembled between the first terminal block and the second terminal block, the first assembly part and the second assembly part can be combined integratedly, the grounding plate is enclosed between the first assembly part and the assembly part, and only other end of the grounding plate is exposed out of the first assembly part and the second assembly part.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
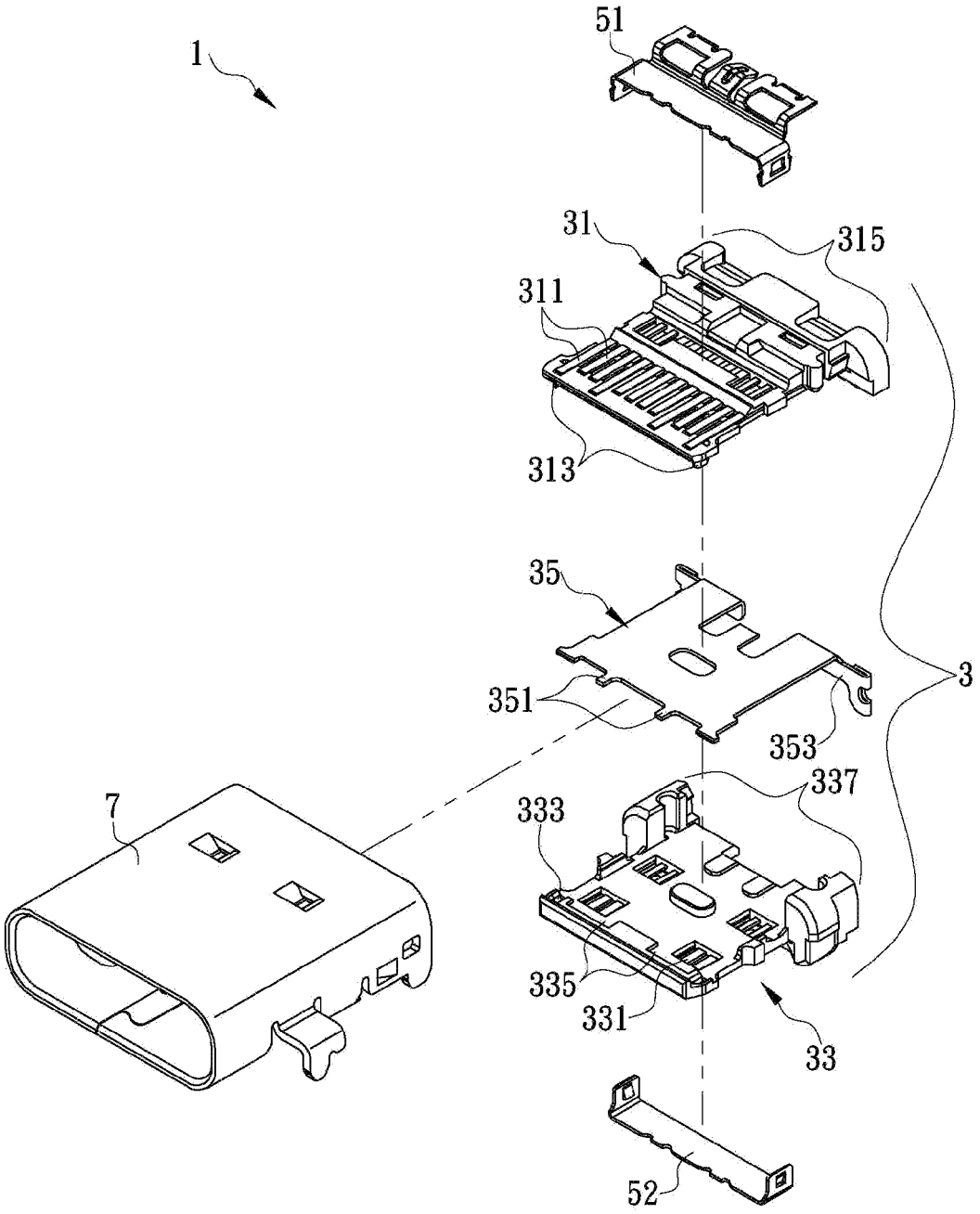
FIG. 1 is an exploded perspective view of a preferred embodiment of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure illustrates a connector in which grounding boards are combined with an assembly tongue plate. Please refer to FIG. 1 which shows a preferred embodiment of the present disclosure. The connector 1 is compatible to the USB Type-C standard and includes an assembly tongue plate 3, two grounding boards 51 and 52, and a metal casing 7. The assembly tongue plate 3 includes a first terminal block 31, a second terminal block 33 and a metal separating plate 35. The first terminal block 31 is made of plastic integrally and provided with a plurality of first connection terminals 311 fixedly disposed therein. Portions of the plurality of first connection terminals 311 are exposed out of a top surface of the first terminal block 31, and the first terminal block 31 is provided with at least one first fastening part 313 at a bottom surface thereof near an end of the first terminal block 31, for example, the first terminal block 31 can be provided with at least one fasten block protrudingly disposed the bottom surface. The second terminal block 33 is made of plastic integrally and provided with a plurality of second connection terminals 331 fixedly disposed therein. Portions of the plurality of second connection terminals 331 are exposed out of a bottom surface of the second terminal block 33, and the second terminal block 33 is provided with at least one second fastening part 333 at a top surface thereof near an end of the second terminal block 33, for example, at least one fastening slot is concavely disposed on the top surface. The second fastening part 333 corresponds to the first fastening part 313.

Structures of a top surface and a bottom surface of the metal separating plate 35 respectively match with a structure of a bottom surface of the first terminal block 31 and a structure of a top surface of the second terminal block 33, to enable the metal separating plate 35 to be assembled between the bottom surface of the first terminal block 31 and the top surface of the second terminal block 33. When the first fastening part 313 is fastened into the second fastening part 333, ends of the first terminal block 31, the metal separating plate 35 and the second terminal block 33 can be firmly integrated.

Please refer back to FIG. 1. The grounding boards 51 and 52 include a first grounding board 51 and a second grounding board 52 respectively. A structure of the first grounding board 51 matches with a structure of the top surface of the first terminal block 31 near other end of the first terminal block 31, and a structure of the second grounding board 52 matches with a structure of the bottom surface of the second terminal block 33 near other end of the second grounding board 52. When the metal separating plate 35 is assembled between the bottom surface of the first terminal block 31 and the top surface of the second terminal block 33, the grounding boards 51 and 52 can be fastened with each other to enclose outer edges of the first terminal block 31 and the second terminal block 33 near other end thereof, whereby the other ends of the first terminal block 31, the metal separating plate 35 and the second terminal block 33 can be firmly integrated together.

Please refer to FIG. 1. The metal casing 7 has a structure matching with the assembly tongue plate 3, so the assembly tongue plate 3 can be assembled into the metal casing 7. Therefore, by just fastening the grounding boards 51 and 52 with each other, the outer edges of the first terminal block 31 and the second terminal block 33 near other end thereof can be enclosed by the grounding boards 51 and 52, whereby the first terminal block 31, the metal separating plate 35 and the second terminal block 33 can be firmly integrated together to form the assembly tongue plate 3. Therefore, the assembly personnel can quickly assemble other ends of the first terminal block 31, and the metal separating plate 35 and the second terminal block 33 together, so convenience and efficiency of assembly can be improved efficiently. In addition, the ends of the first terminal block 31, the metal separating plate 35 and the second terminal block 33 can be firmly fastened with each other by the fastening parts 313 and 333, so the production yield rate of the connector can be further improved efficiently.

Figure 2:
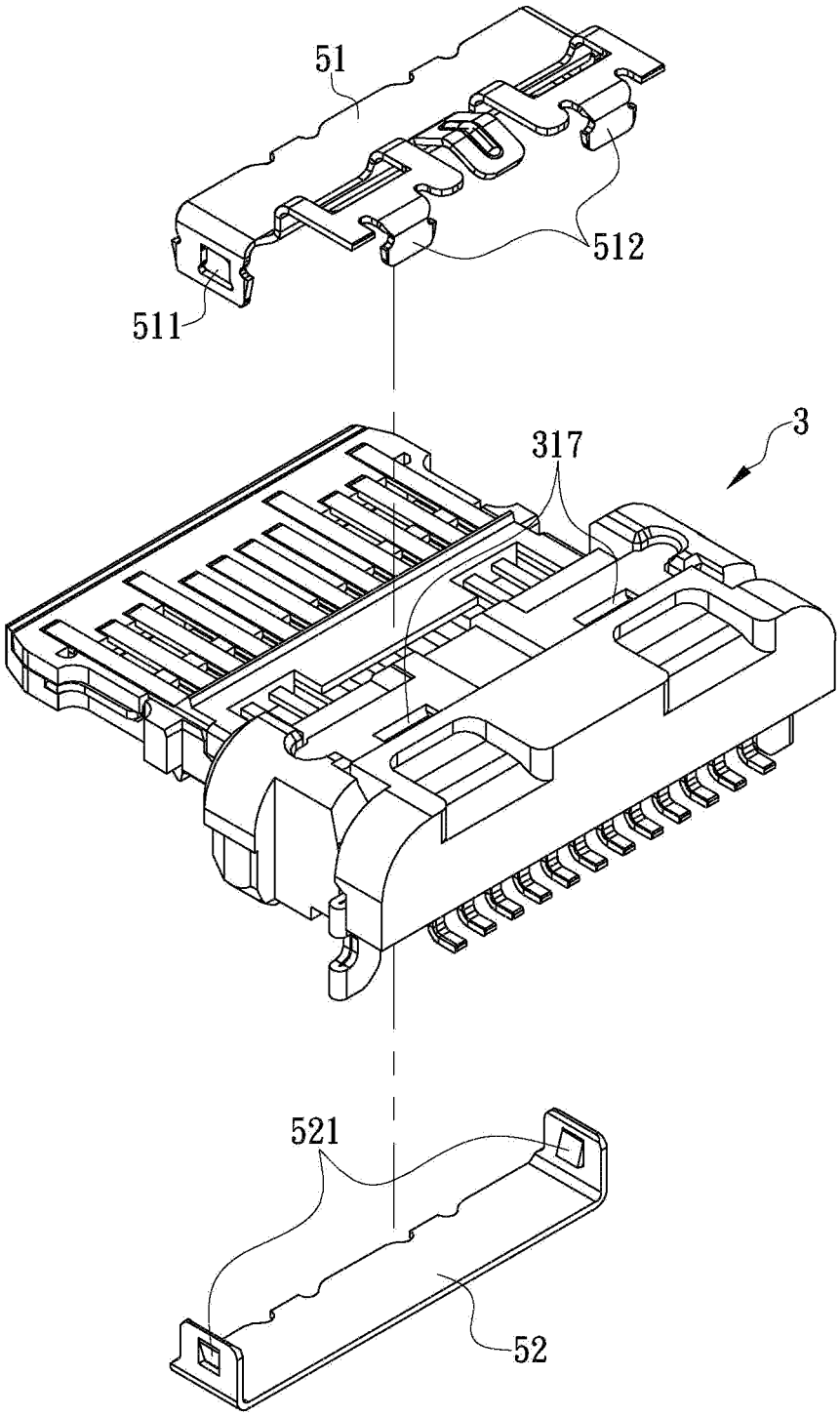
FIG. 2 is a schematic view of the preferred embodiment of the present disclosure.

Please refer to FIG. 1 and FIG. 2. The metal separating plate 35 is provided with at least one third fastening part 351 extended forwardly from an end thereof. At least one fourth fastening part 335 is disposed at the bottom surface of the first terminal block 31 near an end of the first terminal block or at the top surface of the second terminal block 33 near an end of the second terminal block 33. The third fastening part 351 corresponds to the fourth fastening part 335. When the third fastening part 351 is fastened to the fourth fastening part 335, an end of the metal separating plate 35 can be firmly integrated with the end of the first terminal block 31 or the second terminal block 33.

Please refer back to FIG. 1. The metal separating plate 35 is provided with a grounding plate 353 downwardly extended from other end thereof, the first terminal block 31 is provided with a first assembly part 315 at other end thereof, and the second terminal block 33 is provided with a second assembly part 337 at other end thereof. When the metal separating plate 35 is assembled between the first terminal block 31 and the second terminal block 33, the first assembly part 315 and the second assembly part 337 can be combined integratedly, the grounding plate 353 is enclosed between the first assembly part 315 and the second assembly part 337, and only other end of the grounding plate 353 is exposed out of the first assembly part 315 and the second assembly part 337.

Please refer to FIG. 2. In an embodiment of the present disclosure, the first grounding board 51 is provided with first clamping parts 511 at two sides thereof corresponding to each other, for example, openings are disposed at the two sides respectively. The second grounding board 52 is provided with second clamping parts 521 at two sides thereof corresponding to each other, for example, protrudent blocks are protrudingly disposed at the two sides respectively. The second clamping part 521 corresponds to the first clamping part 511, and a structure of the second clamping part 521 matches with that of the first clamping part 511, so the other ends of the first terminal block 31, the metal separating plate 35 and the second terminal block 33 can be firmly integrated together to form the assembly tongue plate 3, and the grounding boards 51 and 52 can be fastened with each other to enable the first clamping part 511 and the second clamping part 521 to be fastened tight with each other, whereby the assembly tongue plate 3 can be firmly enclosed by the grounding boards 51 and 52, and the problem of the assembly tongue plate 3 being loosed possibly can be prevented.

Please refer to FIG. 1 and FIG. 2. In an embodiment of the present disclosure, the first grounding board 51 is provided with a third clamping part 512 disposed at an end thereof, the first terminal block 31 is provided with a clamping slot 317 concavely disposed on a top surface thereof near the other end thereof, and the clamping slot 317 corresponds to the third clamping part 512. A structure of the clamping slot 317 matches with a structure of the third clamping part 512, so the third clamping part 512 can be fastened into the clamping slot 317 when the top surface of the first terminal block 31 is enclosed by the first grounding board 51.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A connector, comprising:

an assembly tongue plate, comprising a first terminal block, a second terminal block and a metal separating plate; wherein the first terminal block is made of plastic integrally and provided with a plurality of first connection terminals fixedly disposed therein, portions of the first connection terminals are exposed out of a top surface of the first terminal block, and the first terminal block is provided with at least one first fastening part at a bottom surface thereof and near an end thereof; wherein the second terminal block is made of plastic integrally and provided with a plurality of second connection terminals fixedly disposed therein, portions of the second connection terminals are exposed out of a bottom surface of the second terminal block, the second terminal block is provided with at least one second fastening part at a top surface thereof and near an end thereof, and the second fastening part corresponding to the first fastening part; wherein structures of a top surface and a bottom surface of the metal separating plate respectively match with a bottom surface of the first terminal block and a top surface of the second terminal block, so as to enable the metal separating plate to be assembled between the bottom surface of the first terminal block and the top surface of the second terminal block, whereby ends of the first terminal block, the metal separating plate and the second terminal block can be firmly integrated in a condition that the first fastening part is fastened into the second fastening part;

two grounding boards having structures matching with the top surface of the first terminal block near other end of the first terminal block and the bottom surface of the second terminal block near the other end of the second terminal block respectively, so as to enable the grounding boards to be fastened with each other to enclose outer edges of the first terminal block and the second terminal block near to the other ends of the first terminal block and the second terminal block in a condition that the metal separating plate is assembled between the bottom surface of the first terminal block and the top surface of the second terminal block, whereby the other ends of the first terminal block, the metal separating plate and the second terminal block can be firmly integrated; and a metal casing, having a structure matching with the assembly tongue plate, whereby the assembly tongue plate can be assembled into the metal casing.

2. The connector as defined in claim 1, wherein the metal separating plate is provided with at least one third fastening part extended forwardly from an end thereof, at least one fourth fastening part is disposed at the bottom surface of the first terminal block near an end of the first terminal block or at the top surface of the second terminal block near an end of the second terminal block the third fastening part corresponding to the fourth fastening part, whereby an end of the metal separating plate can be firmly integrated with the end of the first terminal block or the second terminal block in a condition that the third fastening part is fastened to the fourth fastening part.

3. The connector as defined in claim 1, wherein the metal separating plate is provided with a grounding plate downwardly extended from other end thereof, the first terminal block is provided with a first assembly part at other end thereof, the second terminal block is provided with a second assembly part at other end thereof, and when the metal separating plate is assembled between the first terminal block and the second terminal block, the first assembly part and the second assembly part can be combined integratedly, the grounding plate is enclosed between the first assembly part and the second assembly part, and only other end of the grounding plate is exposed out of the first assembly part and the second assembly part.

4. The connector as defined in claim 2, wherein the metal separating plate is provided with a grounding plate downwardly extended from other end thereof, the first terminal block is provided with a first assembly part at other end thereof, the second terminal block is provided with a second assembly part at other end thereof, and when the metal separating plate is assembled between the first terminal block and the second terminal block, the first assembly part and the second assembly part can be combined integratedly, the grounding plate is enclosed between the first assembly part and the second assembly part, and only other end of the grounding plate is exposed out of the first assembly part and the second assembly part.

5. The connector as defined in claim 3, wherein the two grounding boards comprise a first grounding board and a second grounding board, the first grounding board is provided with first clamping parts respectively disposed at two corresponding side thereof, the second grounding board is provided with second clamping parts respectively disposed at two corresponding side thereof, the second clamping parts correspond to the first clamping parts, and structures of the second clamping parts match with structures of the first clamping parts to enable the first clamping parts and the second clamping parts to be fastened with each other.

6. The connector as defined in claim 4, wherein the two grounding boards comprise a first grounding board and a second grounding board, the first grounding board is provided with first clamping parts respectively disposed at two corresponding side thereof, the second grounding board is provided with second clamping parts respectively disposed at two corresponding side thereof, the second clamping parts correspond to the first clamping parts, and structures of the second clamping parts match with structures of the first clamping parts to enable the first clamping parts and the second clamping parts to be fastened with each other.

7. The connector according to claim 5, wherein the grounding boards comprise a first grounding board and a second grounding board, the first grounding board is provided with a third clamping part disposed at an end thereof, the first terminal block is provided with a clamping slot concavely disposed on a top surface thereof near the other end thereof, the clamping slot corresponds to the third clamping part, and structure of the clamping slot matches with a structure of the third clamping part to enable the third clamping part and the clamping slot to be fastened with each other.

8. The connector according to claim 6, wherein the grounding boards comprise a first grounding board and a second grounding board, the first grounding board is provided with a third clamping part disposed at an end thereof, the first terminal block is provided with a clamping slot concavely disposed on a top surface thereof near the other end thereof, the clamping slot corresponds to the third clamping part, and structure of the clamping slot matches with a structure of the third clamping part to enable the third clamping part and the clamping slot to be fastened with each other.

9. The connector as defined in claim 7, wherein the first fastening part is a fastening block which is protrudingly disposed at a bottom surface of the first terminal block near an end of the first terminal block, the second fastening part is a fastening slot which is concavely disposed at a top surface of the second terminal block near an end of the second terminal block.

10. The connector as defined in claim 8, wherein the first fastening part is a fastening block which is protrudingly disposed at a bottom surface of the first terminal block near an end of the first terminal block, the second fastening part is a fastening slot which is concavely disposed at a top surface of the second terminal block near an end of the second terminal block.

* * * * *